US009616435B2

(12) United States Patent
Smith et al.

(10) Patent No.: US 9,616,435 B2
(45) Date of Patent: Apr. 11, 2017

(54) SELF-CLEANING SPRINKLER

(71) Applicant: RHIZA IRRIGATION LTD., Burnaby (CA)

(72) Inventors: Kenji Smith, Burnaby (CA); Kiyoshi Smith, Burnaby (CA); Kevin Bailey, Ottawa (CA); Matthew Bailey, Ottawa (CA); Duncan J. Gibbons, Stittsville (CA); John Kim, Chelsea (CA); Patrick Williams, Chelsea (CA)

(73) Assignee: RHIZA IRRIGATION LTD., Burnaby (BC) (CA)

( * ) Notice: Subject to any disclaimer, the term of this patent is extended or adjusted under 35 U.S.C. 154(b) by 0 days.

(21) Appl. No.: 14/723,252

(22) Filed: May 27, 2015

(65) Prior Publication Data

US 2015/0343475 A1 Dec. 3, 2015

Related U.S. Application Data

(60) Provisional application No. 62/005,291, filed on May 30, 2014.

(51) Int. Cl.

| | |
|---|---|
| ***B05B 1/00*** | (2006.01) |
| ***B05B 1/26*** | (2006.01) |
| ***B05B 1/30*** | (2006.01) |
| ***B05B 15/02*** | (2006.01) |
| ***B05B 15/06*** | (2006.01) |

(52) U.S. Cl.

CPC ..... *B05B 1/265* (2013.01); *B05B 1/306* (2013.01); *B05B 15/0233* (2013.01); *B05B 15/062* (2013.01)

(58) Field of Classification Search

CPC ..... B05B 1/262; B05B 1/306; B05B 1/265

USPC ..... 239/106, 114–118, 123

See application file for complete search history.

(56) References Cited

U.S. PATENT DOCUMENTS

| | | | | |
|---|---|---|---|---|
| 2,356,738 A * | 8/1944 | Brugger | F04B 7/0053 417/388 |
| 2,585,782 A | 2/1952 | Johnson | |
| 2,720,420 A | 10/1955 | Seifferle | |
| 3,169,522 A * | 2/1965 | Monett | A61F 6/08 128/837 |

(Continued)

OTHER PUBLICATIONS

1-JS Humidifiers plc. *JS JetSpray Atomising Nozzle System Humidifier Manual—Installation, Commisioning, Operation and Maintenance.* JS60/JS600/JS600DS/JS600M. Version 1.34 (UK). 70 pgs. May 30, 2014.

*Primary Examiner* — Arthur O Hall
*Assistant Examiner* — Viet Le
(74) *Attorney, Agent, or Firm* — Saliwanchik, Lloyd & Eisenschenk

(57) ABSTRACT

A self-cleaning sprinkler is disclosed, generally comprised of an upper and lower housing, which encase a nozzle and a diaphragm. The diaphragm moves in an upward and downward position relative to the nozzle, which allows water located within a chamber to be expelled out of an exit aperture of the nozzle. A needle is secured within the diaphragm to correspondingly move in an upward and downward position, such that once in a closed position, the needle will penetrate the exit aperture of the nozzle in order to clean any debris that may have accumulated therein. The diaphragm moves in from a closed position to an open position depending on the incoming water pressure.

8 Claims, 14 Drawing Sheets

(56) References Cited

U.S. PATENT DOCUMENTS

| | | | | |
|---|---|---|---|---|
| 3,204,873 | A | 9/1965 | Senninger | |
| 3,977,608 | A * | 8/1976 | Bullock | B05B 7/32 239/307 |
| 5,052,620 | A * | 10/1991 | Rinkewich | B05B 3/0472 239/101 |
| 6,758,239 | B2 * | 7/2004 | Gregoire | G05D 16/0633 137/505 |

* cited by examiner

SELF-CLEANING SPRINKLER

CROSS REFERENCE TO RELATED APPLICATIONS

The present application claims priority to U.S. Provisional Application No. 62/005,291, filed on May 30, 2014, the disclosure of which is incorporated herein by reference in its entirety.

FIELD

The present disclosure relates to the field of sprinklers, and more specifically to a self-cleaning sprinkler apparatus.

BACKGROUND

Sprinklers have been around for many decades in order to provide for the irrigation of one's soil, land, lawn, etc. Many devices have been devised throughout those decades in order to facilitate said irrigation, and allow us to automate the process and use machines to better control the expulsion of water on soil. Unfortunately, often debris will build up in the nozzle and prevent the effective expulsion of the water out of the nozzle.

Devices such as U.S. Pat. No. 2,585,782 (Johnson) and U.S. Pat. No. 2,720,420 (Seifferle) have attempted facilitate the irrigation process by creating self-flushing or coil-enabled sprinklers. Unfortunately, these devices have some drawbacks that need to be overcome.

Seifferle discloses a self-flushing and pressure regulating fitting for an irrigation sprinkler, which is comprised of a spiral spring that biases a sleeve valve against a conical sieve. The sleeve valve remains in a lower position as long as there is no debris in the sieve. If there is debris that accumulates in the sieve area, it forces the spiral spring upwards and water is permitted to be expelled from a flushing opening, until the debris is out of the system and the sieve can return to its normal position thanks to the spring biased downward towards it. While this device is helpful in circumstances where debris is located coming from the main conduit and into the device, it is not helpful in circumstances where debris accumulates in the nozzle. Further, this device is prone to problems if debris remains stuck in the flushing openings, as they will remain open and water will be constantly out therefrom, resulting in the loss of water both through the nozzle in terms of pressure and overall which will prove costly.

Meanwhile, Johnson discloses a pop-up sprinkler system that uses a compression spring that allows a stem of the system to pop out of the ground for irrigation and back into a cylindrical casting. While this compression system allows for a stem to pop in and out of the ground, it does not provide a means to prevent debris from accumulating in the nozzle or even in the packing material area where the device is positioned in the ground.

SUMMARY

In an aspect, the present device discloses a self-cleaning sprinkler comprising: an upper and lower housing connected to one another for positioning the self-cleaning sprinkler; a nozzle fastened within the upper housing for expelling water from the self-cleaning sprinkler through an exit aperture; a diaphragm coupled to the upper and lower housings, moveable between an open and a closed position to allow a flow of water through the nozzle; and, a needle secured within the diaphragm to expel debris out of the exit aperture of the nozzle when the diaphragm is in a closed position.

BRIEF DESCRIPTION OF THE DRAWINGS

It will now be convenient to describe the device with particular reference to one embodiment of the present device. It will be appreciated that the drawings relate to one embodiment of the present device only and are not to be taken as limiting the device.

DETAILED DESCRIPTION

The present device will now be described more fully hereinafter with reference to the accompanying drawings, in which preferred and other embodiments of the device are shown. No embodiment described below limits any claimed device and any claimed device may cover processes or apparatuses that are not described below. The claimed devices are not limited to apparatuses or processes having all the features of any one apparatus or process described below or to features common to multiple or all of the apparatuses described below. It is possible that an apparatus or process described below is not an embodiment of any claimed device. The applicants, inventors or owners reserve all rights that they may have in any device claimed in this document, for example the right to claim such an device in a continuing application and do not intend to abandon, disclaim or dedicate to the public any such device by its disclosure in this document.

Figure 1:
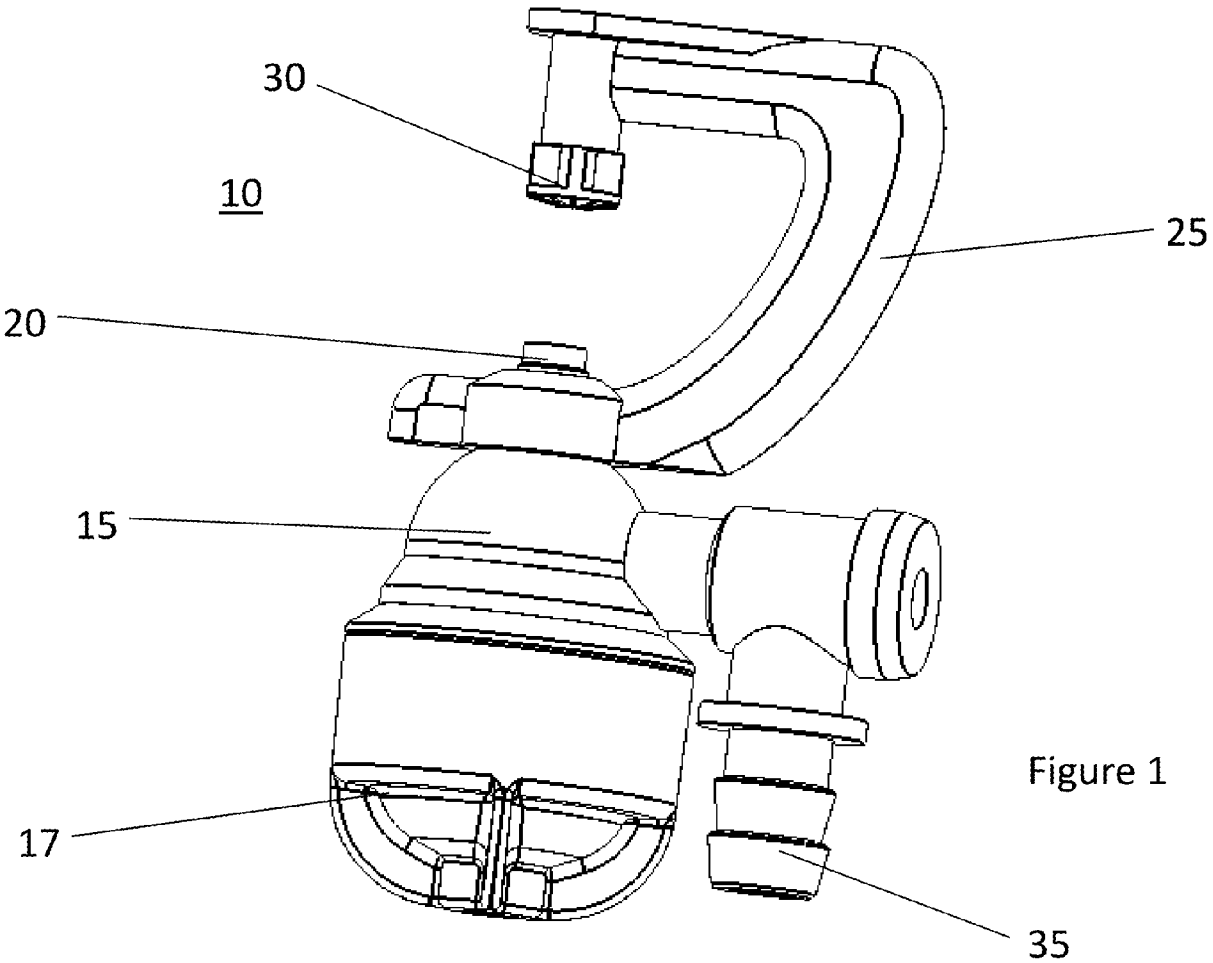
FIG. 1 is a perspective view of a self-cleaning sprinkler, according to an embodiment of the present device.

With reference to FIG. 1, a self-cleaning sprinkler 10 is shown generally comprised of an upper and lower housing 15, 17, said upper housing 15 being in threaded engagement with the lower housing 17. The sprinkler 10 is further comprised of a spray nozzle 20, a diverter arm 25 and a water diverter 30. The nozzle 20 is shown fastened within the upper housing 15 and will allow water to be expelled therefrom through an exit aperture (not shown). The diverter arm 25 is shaped in such a way so as to allow water to be forced out of the spray nozzle 20 and straight up towards the diverter 30. In turn, the diverter 30 has ribs (not shown) that protrude from an upper portion thereof in order to redirect water across a surface such as a lawn. The sprinkler 10 is designed to be connected directly to a water source such as a hose through a hose connection portion 35 of the upper housing 15. A suitable hose end is inserted over said hose connection portion 35 to direct water into an inlet aperture (not shown) of said hose connection portion 35.

Figure 2A:
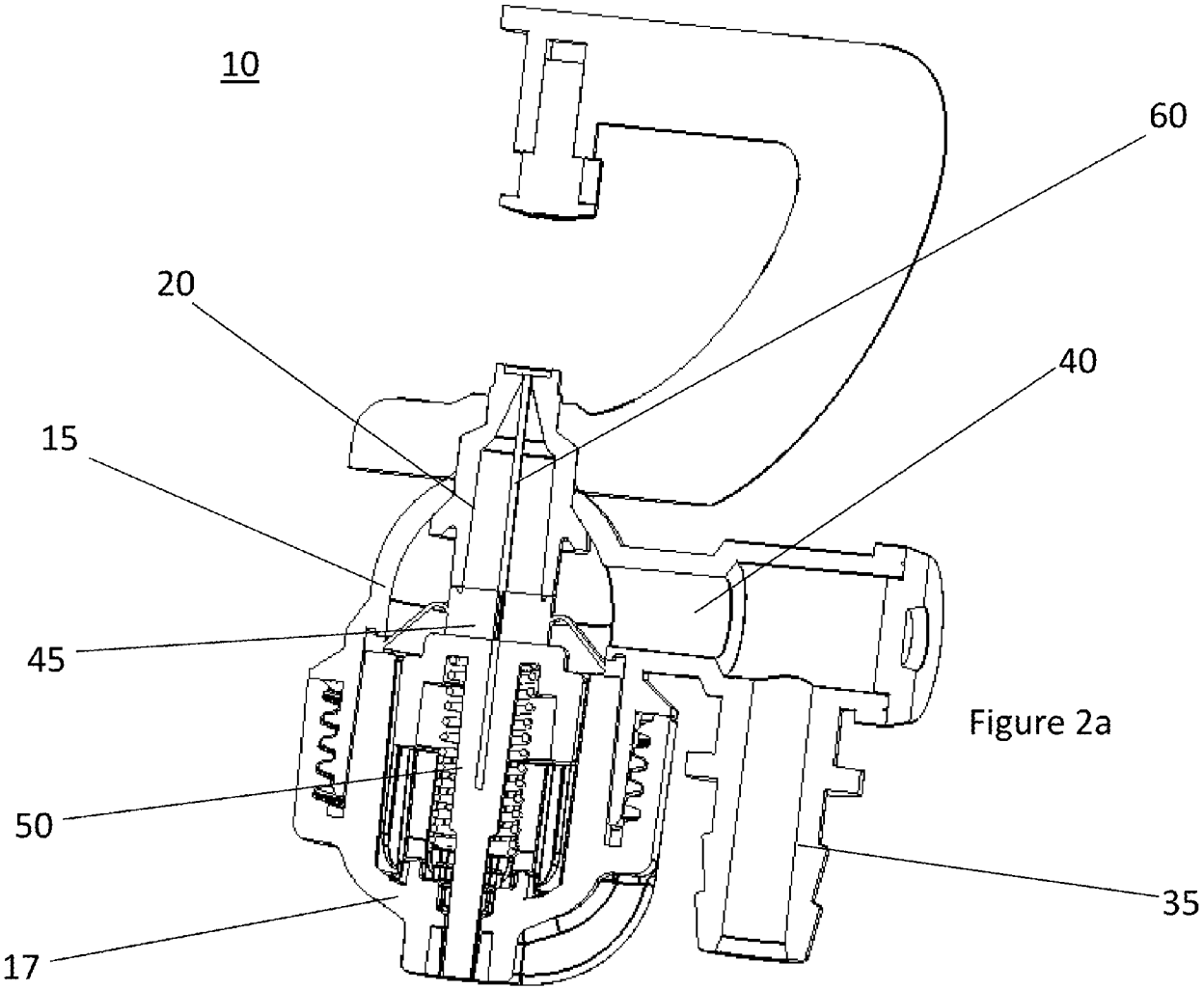
FIG. 2*a* is a cross-sectional perspective view of a self-cleaning sprinkler in a closed position, according to an embodiment of the present device.
Figure 2B:
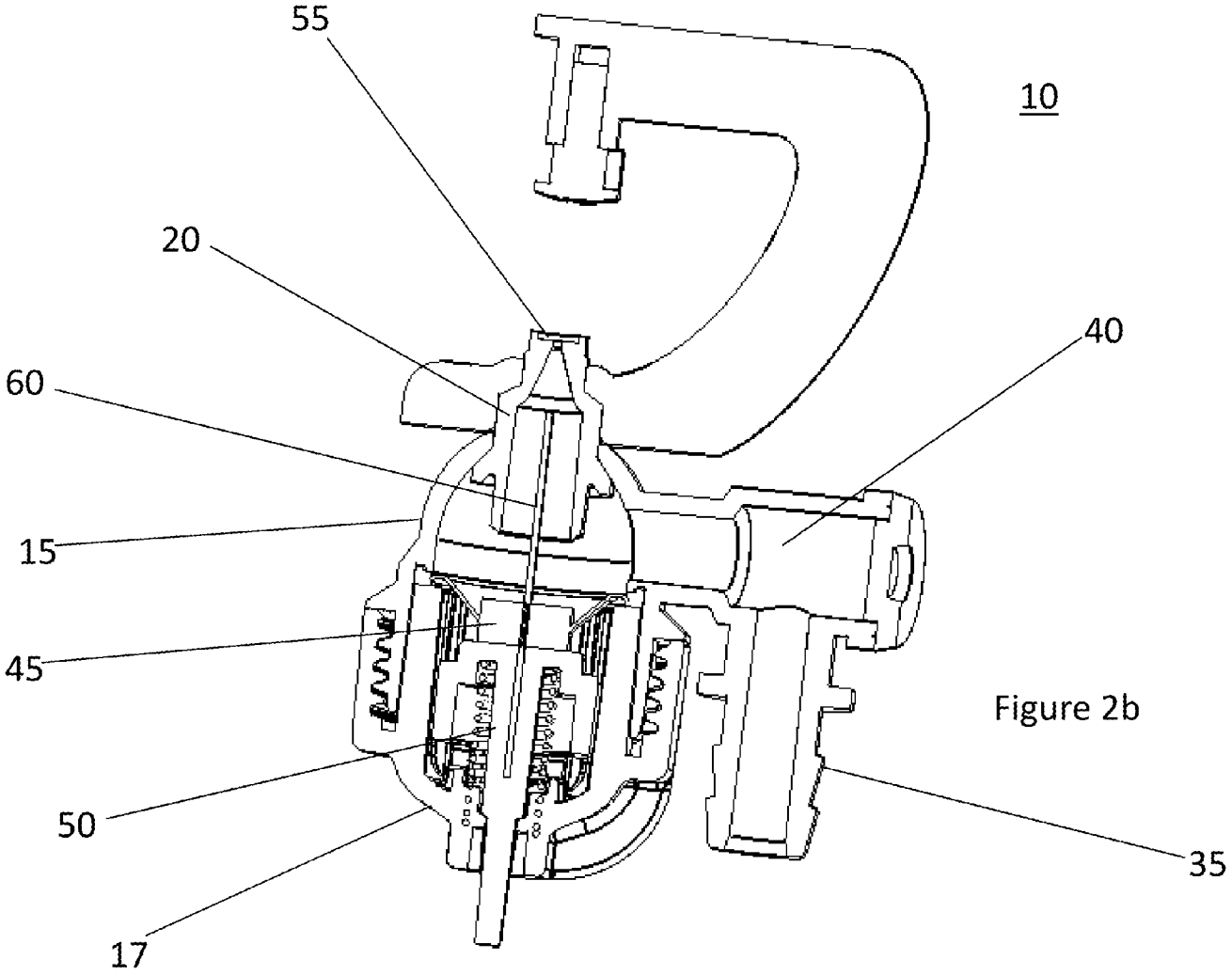
FIG. 2*b* is a cross-sectional perspective view of a self-cleaning sprinkler in an open position, according to an embodiment of the present device.

With reference to FIGS. 2*a* and 2*b* and according to an embodiment of the present device, the sprinkler 10 is shown in a closed and an open position, respectively. In the closed position, water flows into a chamber 40 of the hose connection portion 35. The chamber 40 is defined as the area limited by the interior walls of the hose connection portion 35, upper housing 15, nozzle 20 and a diaphragm 45 as specifically shown in FIG. 2*a*. A biasing assembly 50 is retained within the lower housing 17, and said biasing assembly 50 is operatively engaged with the diaphragm 45, biasing said diaphragm 45 upwardly in a closed position in order to create said chamber 40 and prevent the water within the sprinkler 10 to be expelled from the nozzle 20. When the water pressure is sufficiently high, said water pressure overcomes the biasing force exerted upon the diaphragm 45 by the biasing assembly 50, such that said diaphragm moves into an open position as specifically shown in FIG. 2*b*. As chamber 40 is no longer an enclosed environment, water is forced upwardly and expelled out from an exit aperture 55 of the nozzle 20. Once the water pressure is necessarily low enough, the biasing force exerted upon the diaphragm 45 by the biasing assembly 50 will overcome said water pressure and move said diaphragm 45 back into its closed position as shown in FIG. 2*a*. A needle 60 located and secured within the biasing assembly 50 and diaphragm 45 moves from an open position as shown in FIG. 2*b* to a closed position as shown in FIG. 2*a* within the exit aperture 55 of the nozzle 20. In doing so, the needle 60 serves to expel debris that has accumulated within the exit aperture 55 and nozzle 20 during watering when the sprinkler 10 is in the open position. Once in the closed position, the positioning of the needle 60 also blocks insects and debris from entering the nozzle 20 which often occurs in traditional sprinklers.

Figure 3:
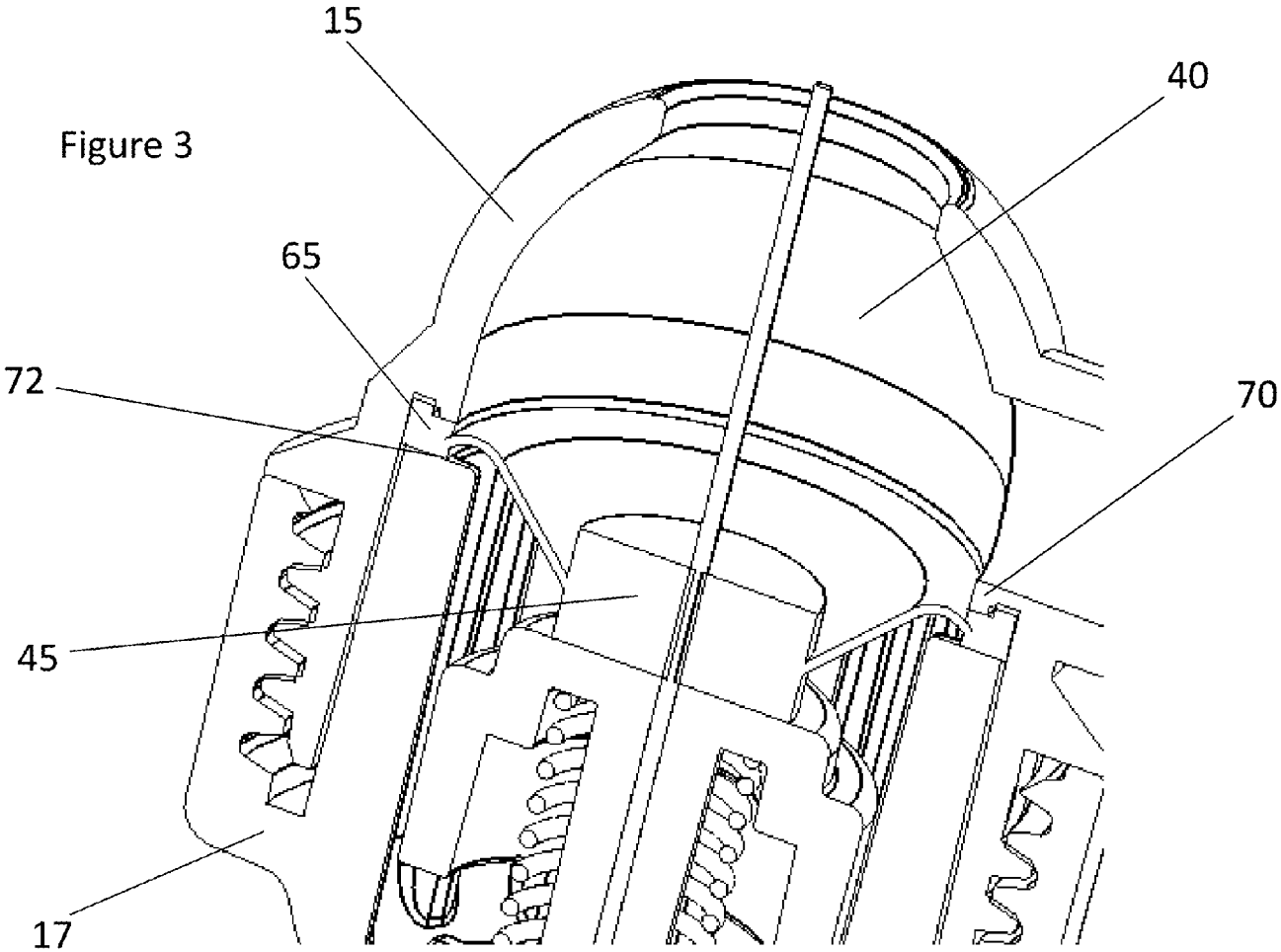
FIG. 3 is a cross-sectional perspective view of a diaphragm in an open position coming into contact with the upper and lower housing of the self-cleaning sprinkler, according to an embodiment of the present device.

With reference to FIG. 3 and according to an embodiment of the present device in an open position, the diaphragm 45 is comprised of an annular periphery 65 which is sandwiched between an annular nub 70 of the upper housing 15 and an annular wall 72 of the lower housing 17. Therefore, a watertight connection is created between said annular periphery 65 of the diaphragm 45 and the upper housing 15 to define a portion of the chamber 40. As the diaphragm 45 is currently in an open position, water can flow into the chamber 40 and out of the nozzle (not shown).

Figure 4A:
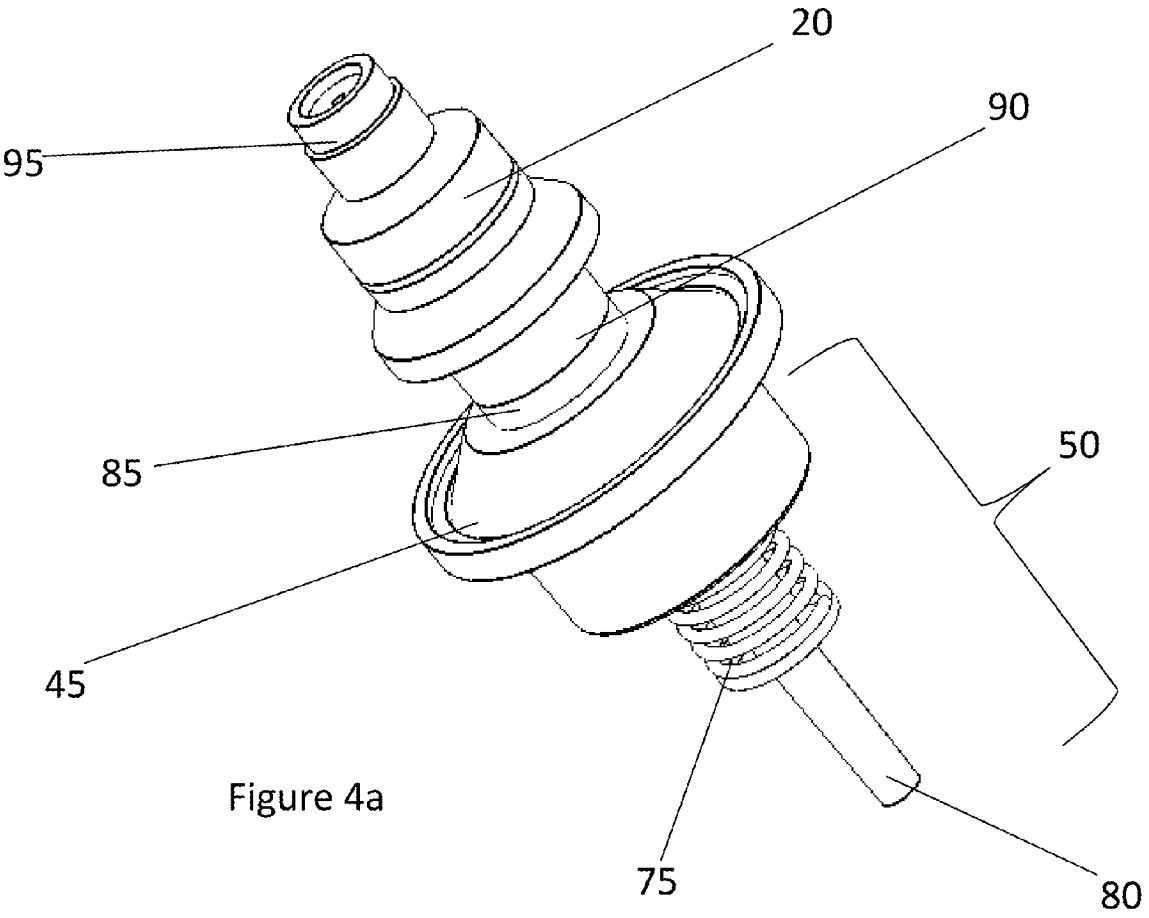
FIG. 4*a* is a perspective view of a biasing assembly and diaphragm in a closed position relative to a nozzle of the self-cleaning sprinkler, according to an embodiment of the present device.
Figure 4B:
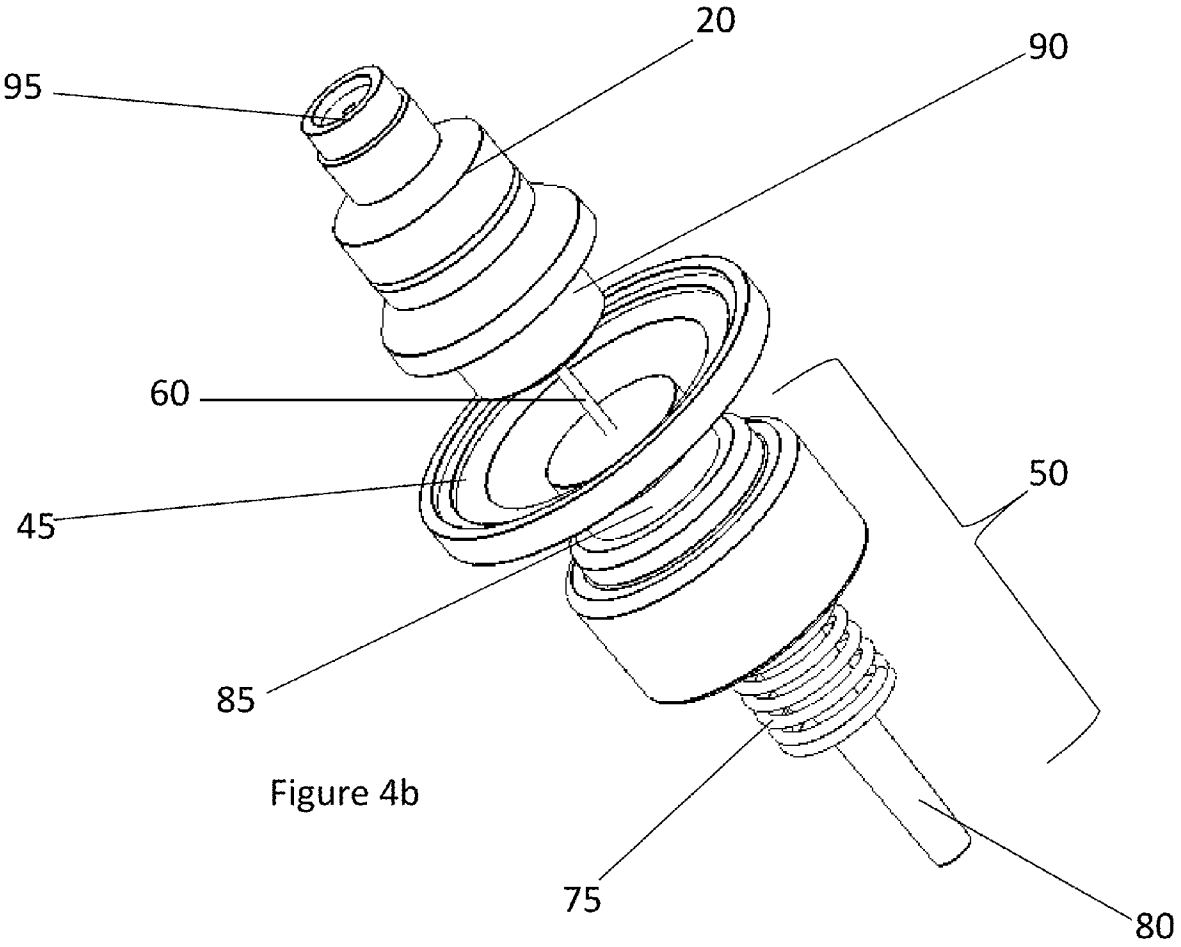
FIG. 4*b* is a perspective view of a biasing assembly and diaphragm in an open position relative to a nozzle of the self-cleaning sprinkler, according to an embodiment of the present device.

With reference to FIGS. 4*a* and 4*b* and according to an embodiment of the present device, the biasing assembly 50 is shown biasing the diaphragm 45 in a closed and open position, respectively. The biasing assembly 50 is comprised of a spring 75 and a piston 80, said piston 80 operatively engaged with a core member 85 of the diaphragm 45 to bias said diaphragm in either the closed or open position. In turn, when in a closed position, the core member 85 of the diaphragm comes into contact with an abutment protrusion 90 of the nozzle 20 and creates a seal with said abutment protrusion 90. As such, water cannot enter the nozzle 20. When the water pressure in the chamber (not shown) is beyond a certain threshold, the biasing force of the piston 80 of the biasing member 50 is overcome such that the diaphragm 45 can move into an open position, as shown in FIG. 4*b*, and then core member 85 of the diaphragm 45 is no longer in contact with the abutment protrusion 90 of the nozzle 20, and water can enter said nozzle 20. As was previously explained, the needle 60 (shown only in FIG. 4*b*) is fastened within the core member 85 of the diaphragm 45 and also within the piston 80. As such, said needle 60 moves up and down in between a closed and open position, respectively. In a closed position, the needle 60 is forced into the exit aperture (not shown) located in an upper portion 95 of the nozzle 20 and cleans the debris that has accumulated therein. The positioning of the needle 60 in the closed position also prevents debris or insects from entering the exit aperture (not shown) of the nozzle 20 and getting lodged within said nozzle 20.

Figure 5A:
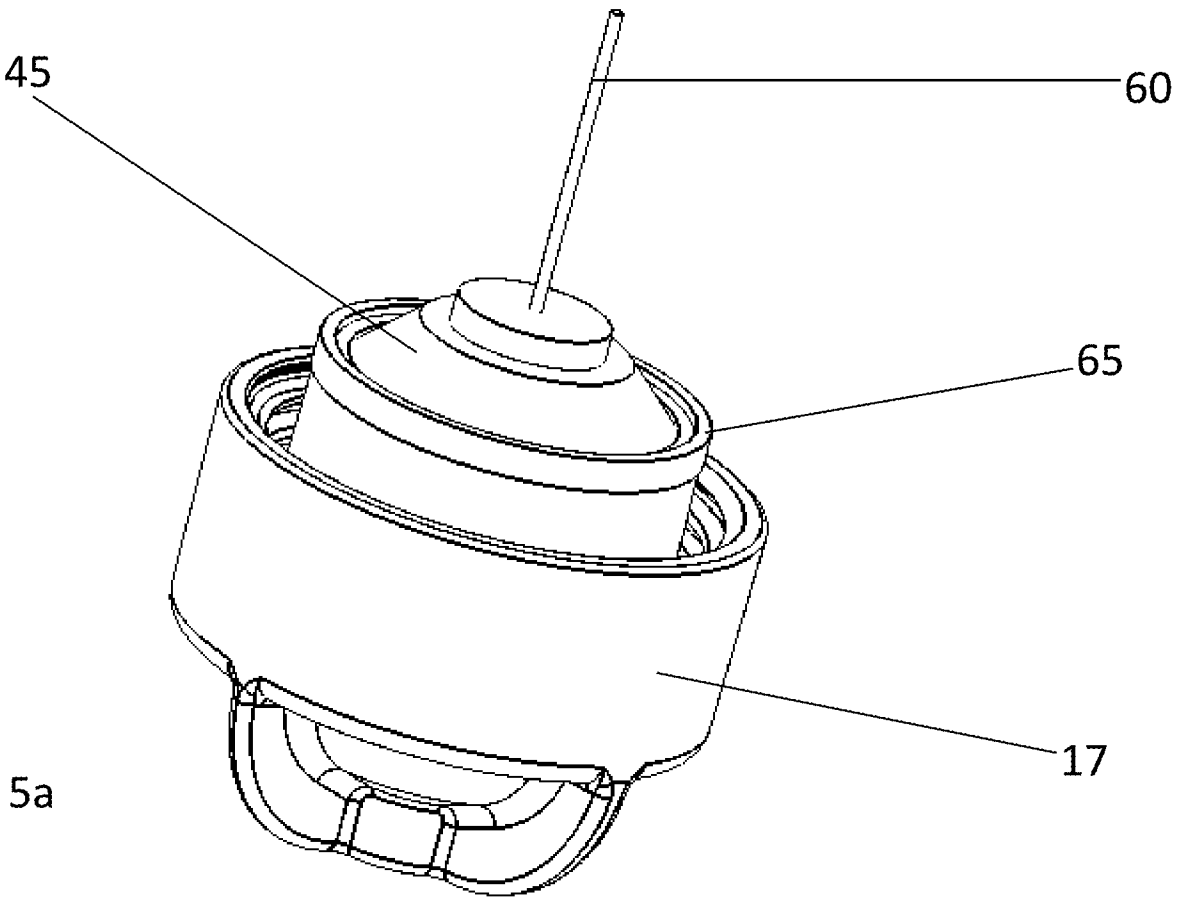
FIG. 5*a* is a perspective view of a diaphragm and needle in a closed position relative to the lower housing of the self-cleaning sprinkler, according to an embodiment of the present device.
Figure 5B:
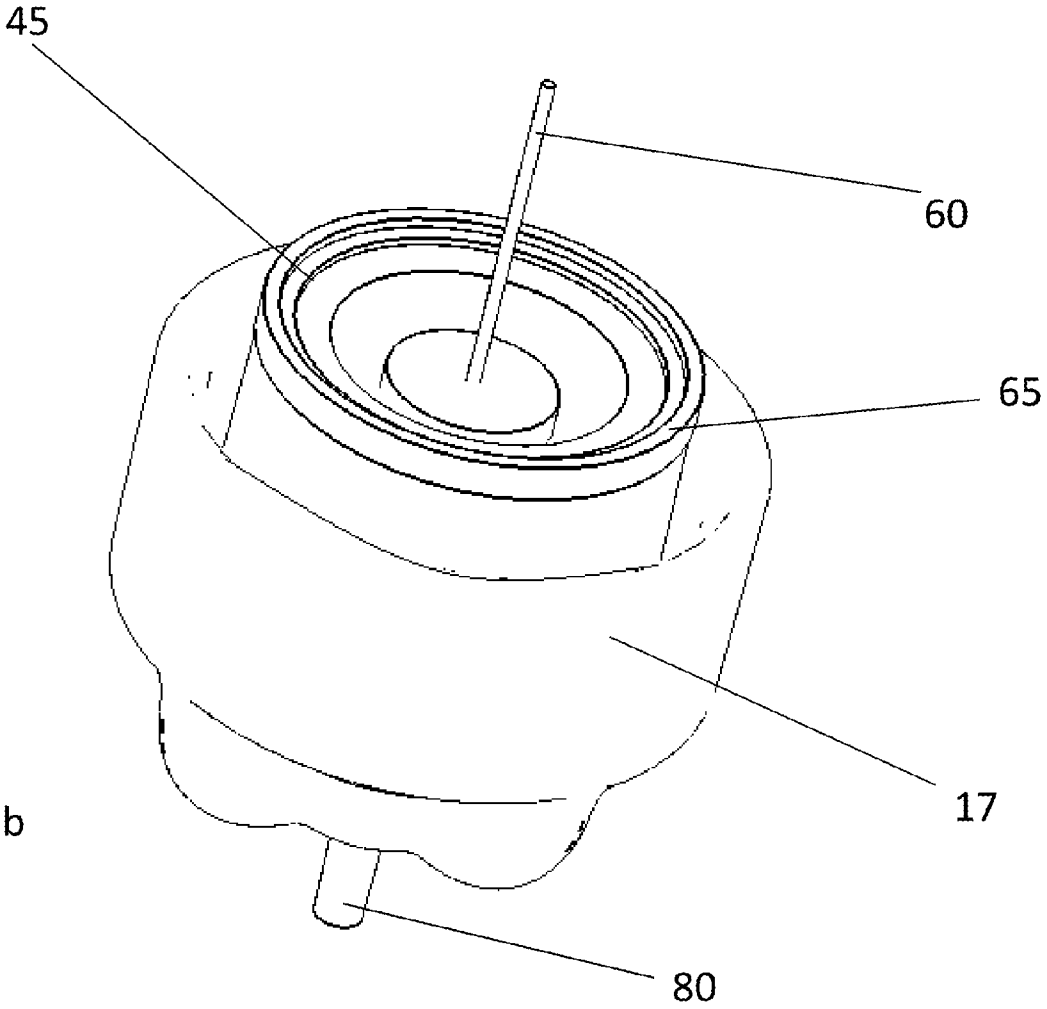
FIG. 5*b* is a perspective view of a diaphragm, needle and shaft in an open position relative to the lower housing of the self-cleaning sprinkler, according to an embodiment of the present device.

With reference to FIGS. 5*a* and 5*b*, the diaphragm 45, needle 60 and piston 80 (only shown in FIG. 5*b*) are shown in a closed position and open position with respect to the lower housing 17, respectively. For clarity, the lower housing 17 remains stationary; only the piston 80, diaphragm 45 and needle 60 in an upward and downward position. As was explained previously, the annular periphery 65 is always in contact with the annular wall (not shown) of the lower housing 17 to create a waterproof seal therebetween.

Figure 6B:
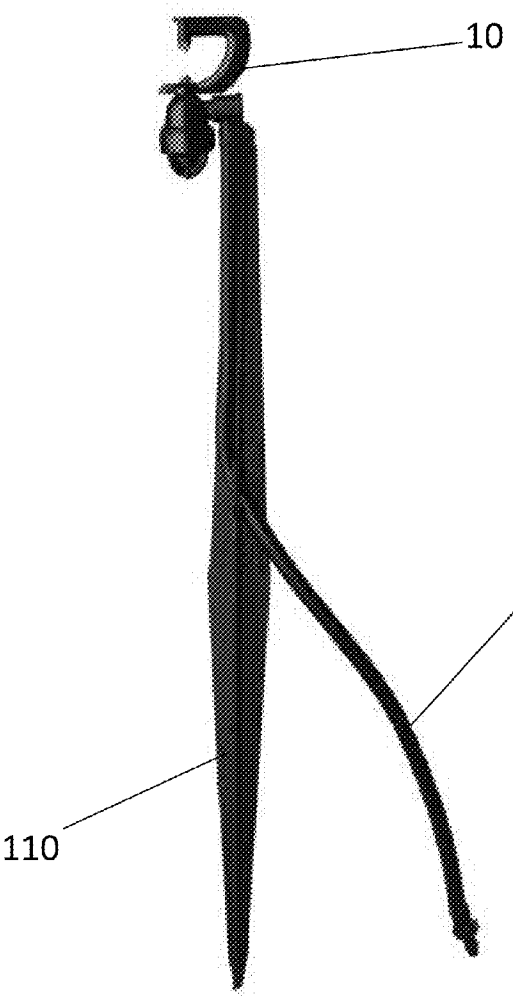
FIG. 6*b* is a front view of a self-cleaning sprinkler in a stake assembly configuration according to an embodiment of the present device.
Figure 6A:
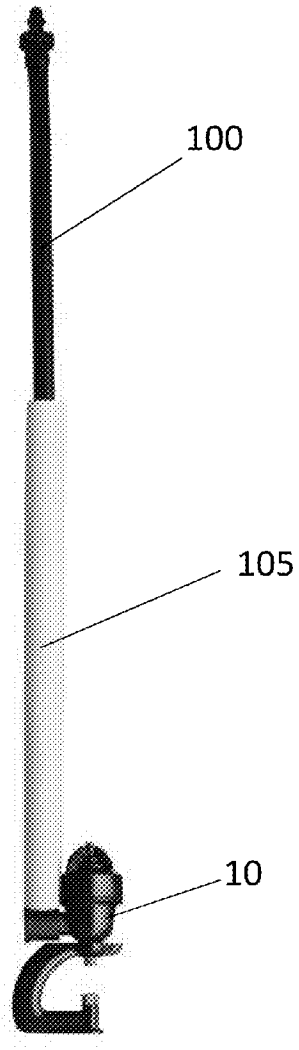
FIG. 6*a* is a front view of a self-cleaning sprinkler in an inverter assembly configuration, according to an embodiment of the present device.
Figure 7:
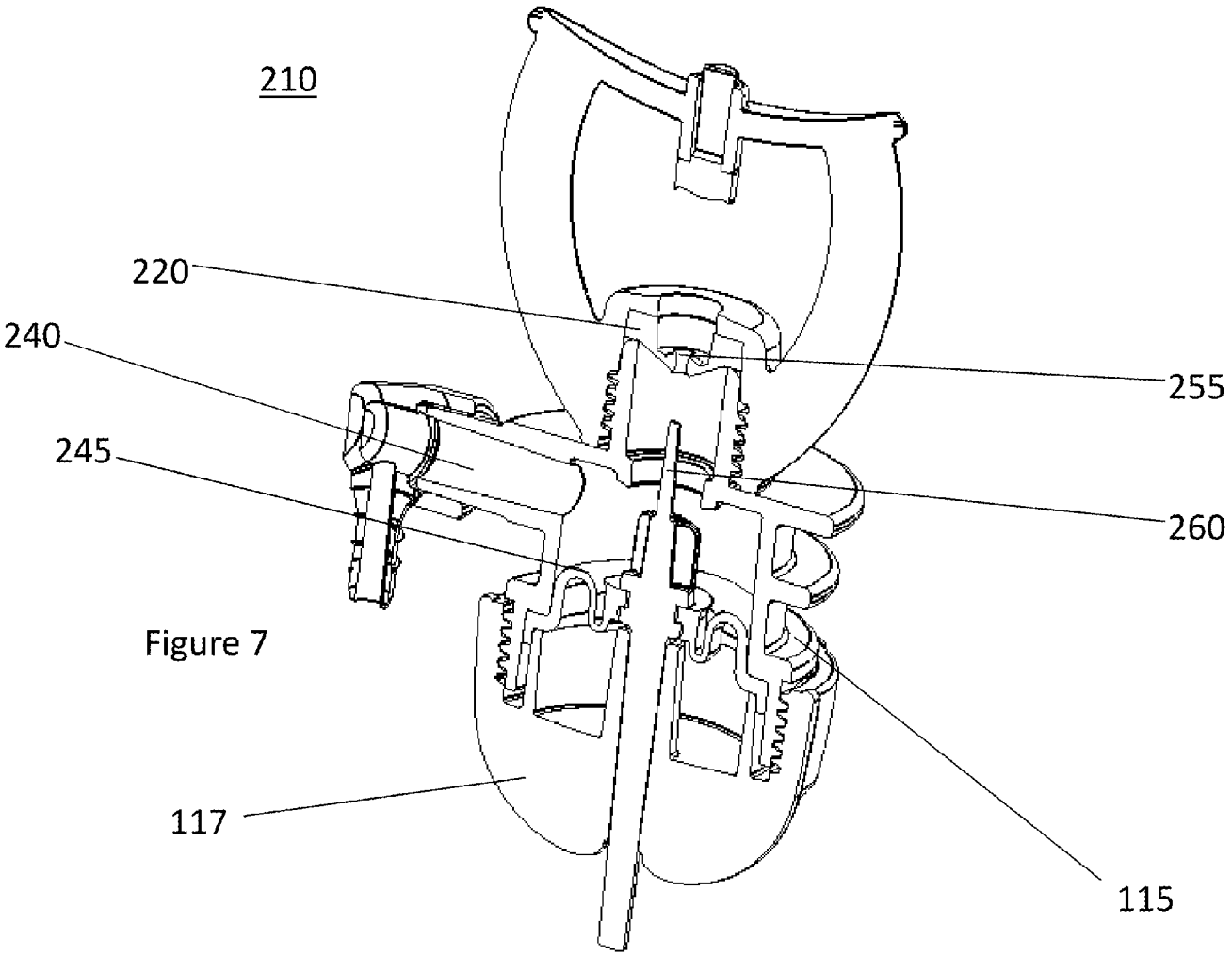
FIG. 7 is a perspective cross-sectional view of a self-cleaning sprinkler in an open position according to another embodiment of the present device.
Figure 8:
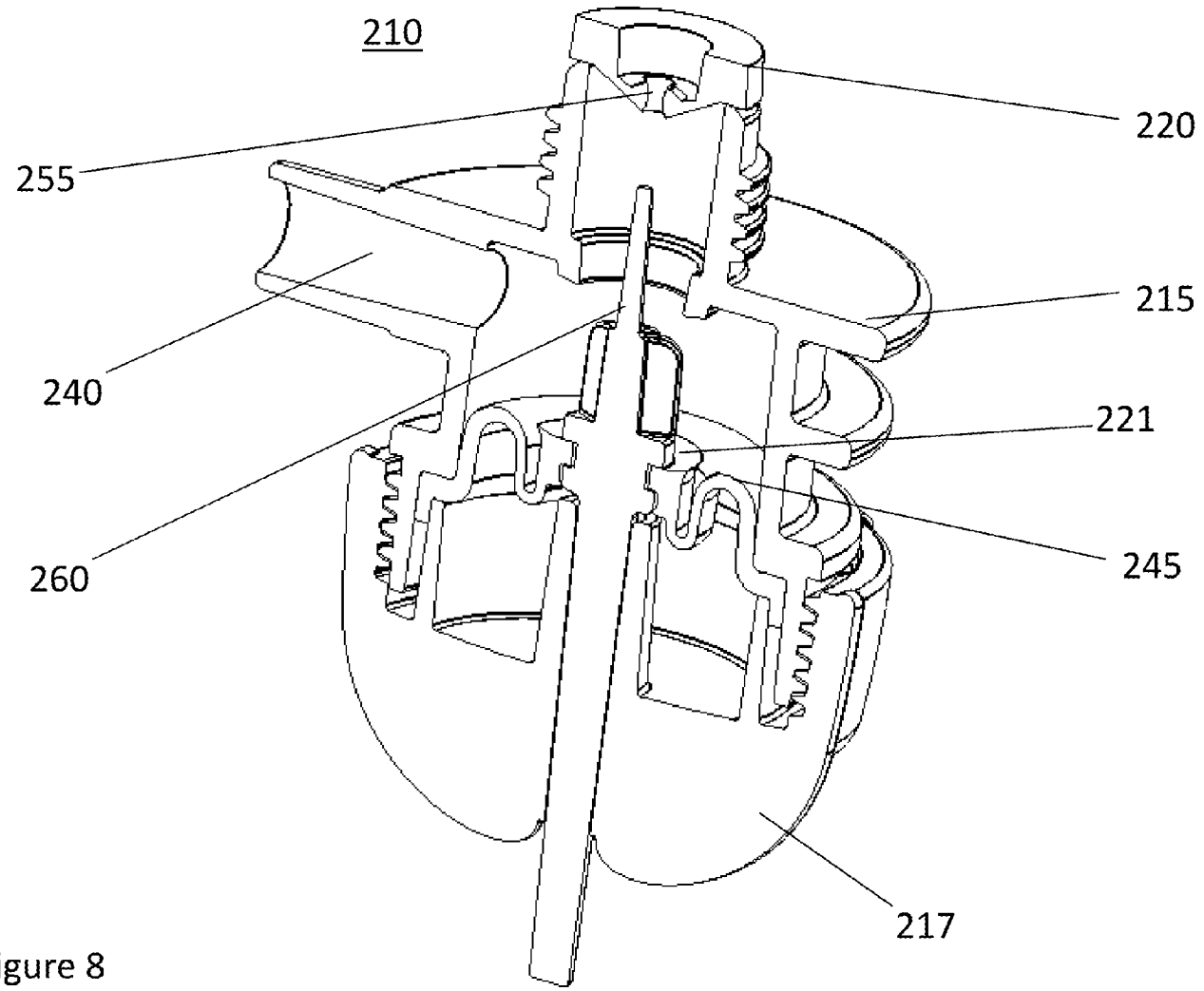
FIG. 8 is a second perspective cross-sectional view of a self-cleaning sprinkler in an open position according to another embodiment of the present device.
Figure 9B:
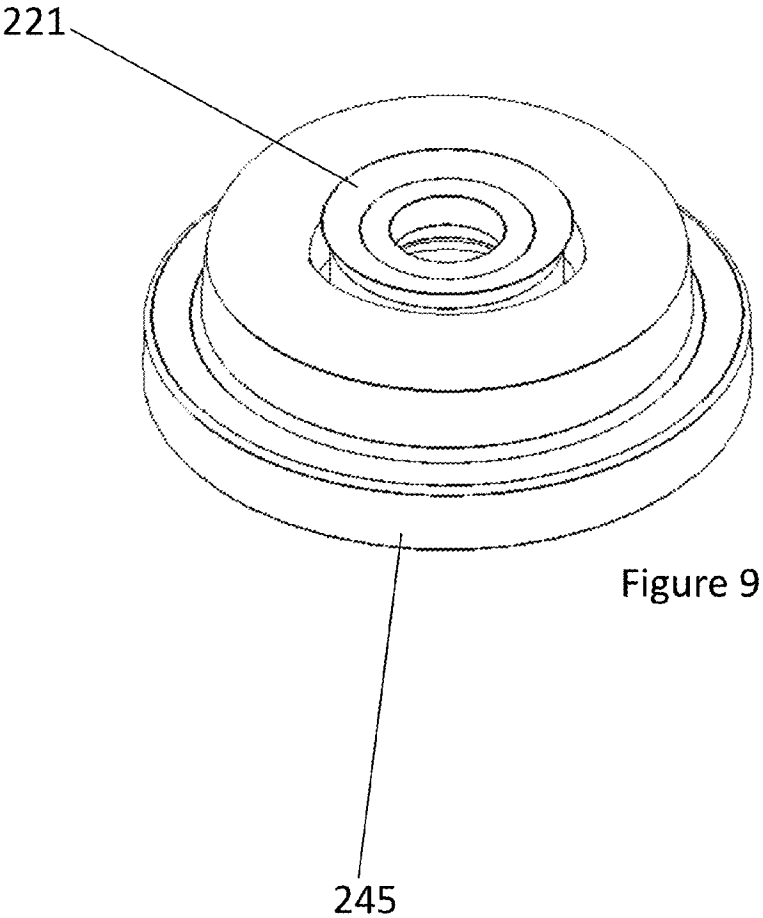
FIG. 9*b* is a perspective view of a diaphragm of a self-cleaning sprinkler in an open position according to another embodiment of the present device.
Figure 9A:
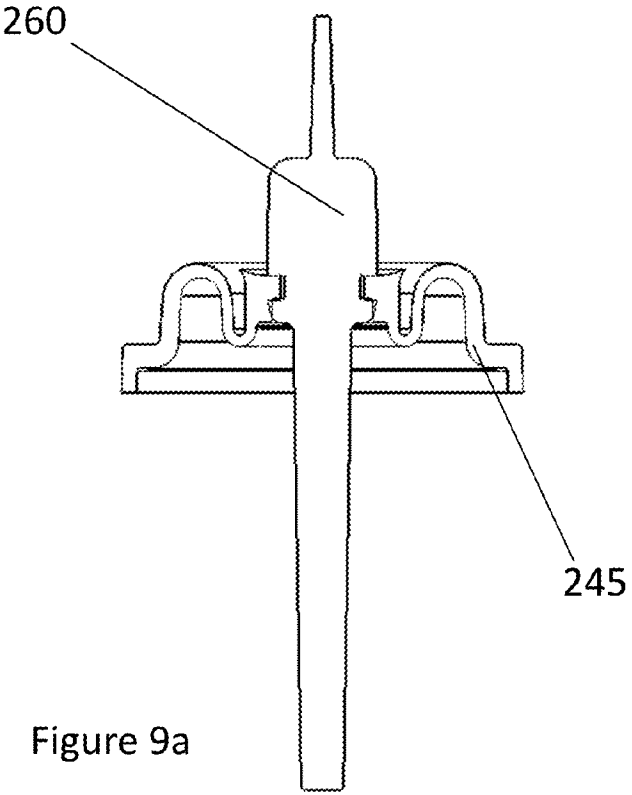
FIG. 9*a* is a front cross-sectional view of a diaphragm connected to a needle in an open position according to another embodiment of the present device.

With reference to FIGS. 6*a* and 6*b* and according to an embodiment of the present device, the sprinkler 10 is shown connected in an inverted assembly and stake assembly configuration, respectively. In each assembly configuration, a water supply line 100 is shown which must be connected to the hose connector portion (not shown) of the sprinkler 10. For the sprinkler 10 in the inverted assembly configuration, a stabilizer 110 is present to steady the sprinkler 10 as water travels from the water supply line 100 to said sprinkler 10 and out of the nozzle (not shown). In said inverted assembly configuration, the sprinkler 10 is positioned upside down. Meanwhile, in the stake assembly configuration, the sprinkler 10 is positioned right side up and again connected to a water supply conduit 100 by means of the hose connector portion (not shown). A stake 105 is also present, which is driven into the ground in order to secure the sprinkler 10 to the ground in an upright position. In this particular embodiment, the stake 105 is clipped to the water supply line 100 but a worker skilled in the relevant art would appreciate that the stake could be connected in various ways.

With reference to FIGS. 7, 8, 9*a* and 9*b* and according to another embodiment of the present device, a self-cleaning sprinkler 210 is shown in an open position, generally comprised of upper and lower housings 115, 117 in threaded engagement with one another for positioning the self-cleaning sprinkler 210. A worker skilled in the art would appreciate that threaded engagement could simply be connected, such that the housings are connected one to the other by other means other than threaded. The sprinkler 210 is further comprised of a nozzle 220 fastened within the upper housing 115 for expelling water from the sprinkler 210 through an exit aperture 255, and a diaphragm 245 coupled to the upper and lower housings 115, 117 which is moveable between an open and a closed position to allow the flow of water through said nozzle 220. A needle 260 is also disclosed, secured within the diaphragm 245 to expel debris out of the exit aperture 255 of the nozzle 220 when the diaphragm 245 is in a closed position. In this embodiment, the biasing assembly that was present in the earlier embodiment is no longer needed, as the diaphragm 245 is shaped in such a way so as to constantly bias itself upwardly, in the closed position. In this embodiment, as water is forced into the chamber 240 of the hose connecting portion 235, it forces the diaphragm 245 to be biased downwardly in the ripple shape as specifically shown in FIGS. 7, 8 and 9. Since the diaphragm 245 is made of rubber or other suitable flexible material, the pressure of the water maintains the diaphragm in the open position until the water is turned off. When the water is turned off, it engenders a corresponding reduction in the pressure of the water incoming from the hose connecting portion 235, until a point where the normal upward biasing of the diaphragm 245 overcomes the water pressure and the diaphragm 245 returns to its normal closed position which is in the shape of a dome. In doing so, the needle 260 is moved in a closed position, penetrating the exit aperture 255 and clearing it of debris and dirt to reduce blockage of the sprinkler 210. As is clearly shown, the shape of the diaphragm 245 is self-biasing in a closed position. In other words, the diaphragm 245 is only forced into its ripple-shape by water pressure overcoming the natural dome-shape of the diaphragm 245. It should be noted that the diaphragm 245 is further comprised of a cylindrical concave portion 221 which will mate and create a waterproof seal with a corresponding cylindrical convex portion 222 of the upper housing 115.

Figure 10:
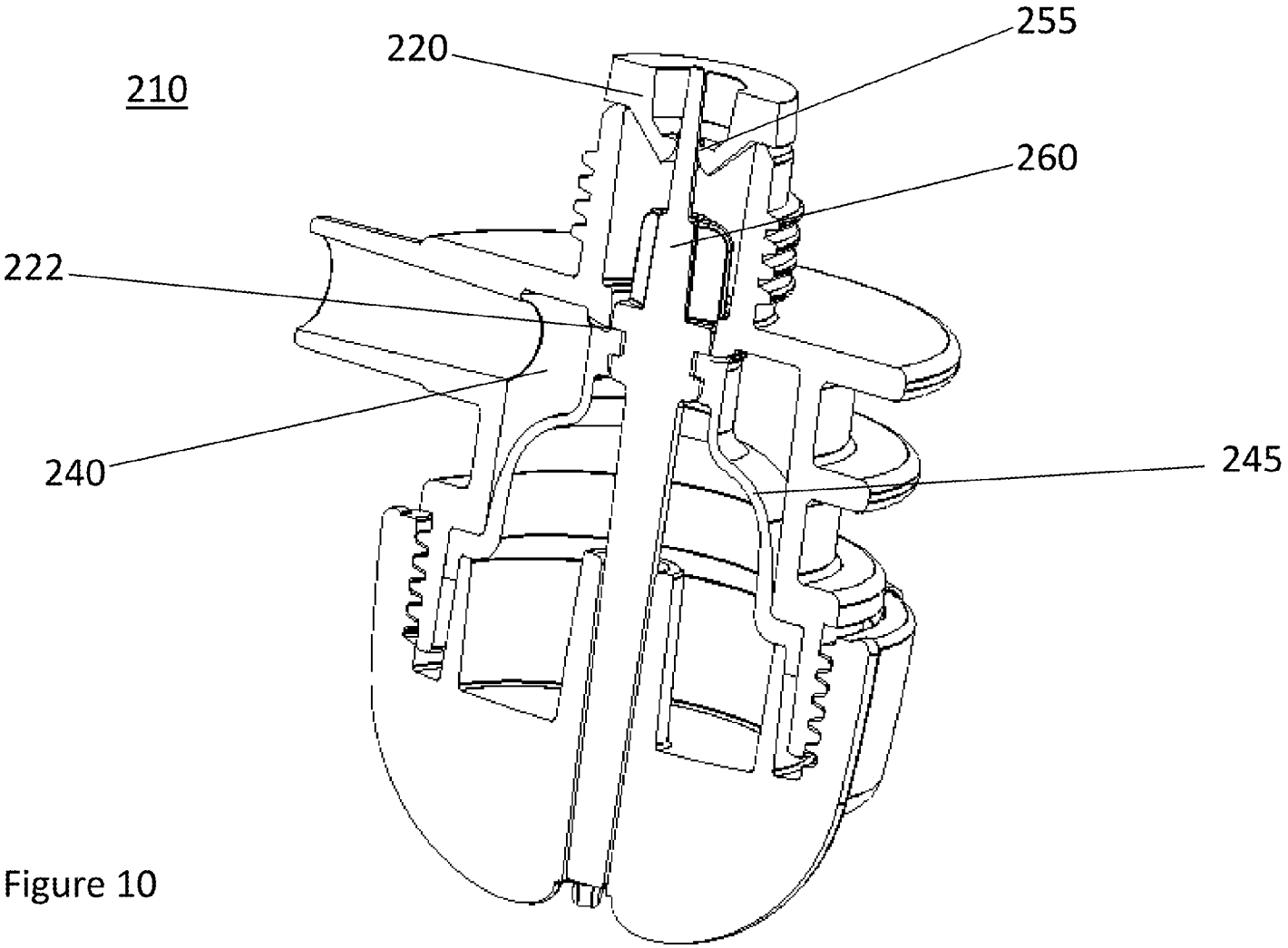
FIG. 10 is a perspective cross-sectional view of a self-cleaning sprinkler in a closed position according to another embodiment of the present device; and, FIG. 11 is a front cross-sectional view of a diaphragm connected to a needle in a closed position according to another embodiment of the present device.
Figure 11:
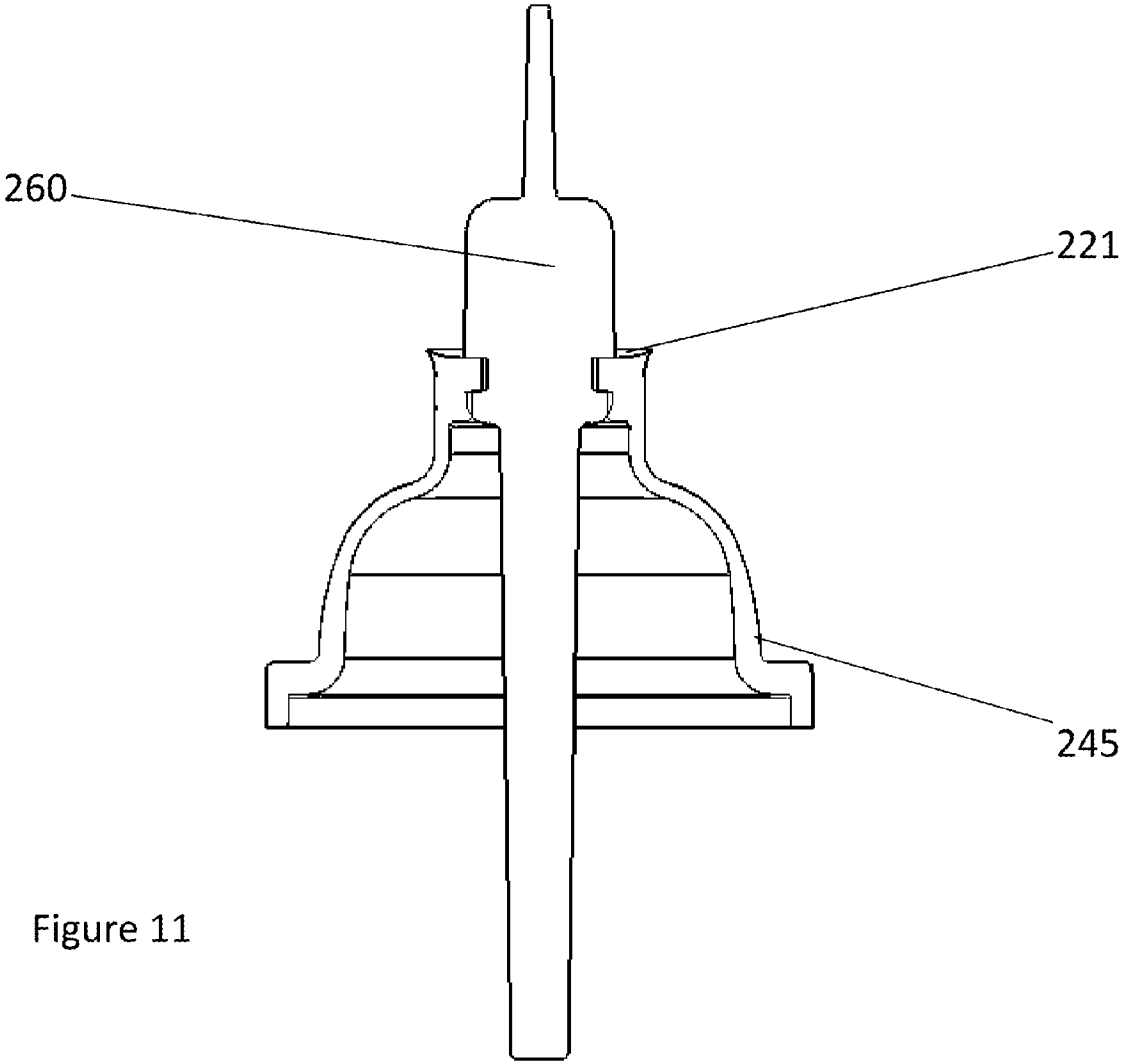

With reference to FIGS. 10 and 11, the and according to another embodiment of the present device, a self-cleaning sprinkler 210 is shown in a closed position. In this closed position, the diaphragm 245 is shown in its uncollapsed, normal dome-shape. Further, the needle 260 is shown completely penetrating the exit aperture 255, clearing the nozzle 220 of any debris. In the closed position of the sprinkler 210, the cylindrical concave portion 221 of the diaphragm 245 is mated with the corresponding cylindrical convex portion 222 of the upper housing 115, thereby creating a waterproof seal and not permitting other debris, dust or water to enter the chamber 240.

Although the device has been described above by reference to certain embodiments of the device, the device is not limited to the embodiments described above. Modifications and variations of the embodiments described above will occur to those skilled in the art in light of the above teachings. Moreover, with respect to the above description, it is to be repulsed that the optimum dimensional relationships for the component members of the present device may include variations in size, material, shape, form, funding and manner of operation.

The invention claimed is:

1. A self-cleaning sprinkler comprising:

a. an upper and lower housing connected to one another for positioning the self-cleaning sprinkler;

b. a nozzle fastened within the upper housing for expelling water from the self-cleaning sprinkler through an exit aperture;

c. a diaphragm coupled to the upper and lower housings, moveable between an open and a closed position to allow a flow of water through the nozzle; and, d. a needle secured within the diaphragm to expel debris out of the exit aperture of the nozzle when the diaphragm is in a closed position;

wherein the diaphragm is dome-shaped in the closed position, the dome shape self-biasing the diaphragm in the closed position, thereby preventing the flow of water through the nozzle.

2. The self-cleaning sprinkler of claim 1 further comprised of a biasing assembly.

3. The self-cleaning sprinkler of claim 2 wherein the biasing assembly is further comprised of a spring and a piston.

4. The self-cleaning sprinkler of claim 1 wherein the upper and lower housings are in threaded engagement with one another.

5. The self-cleaning sprinkler of claim 1 further comprised of a water diverter.

6. The self-cleaning sprinkler of claim 1 wherein the diaphragm is ripple-shaped in an open position.

7. The self-cleaning sprinkler of claim 1 wherein the upper housing is further comprised of cylindrical convex portion.

8. The self-cleaning sprinkler of claim 7 wherein the diaphragm is further comprised of a cylindrical concave portion to mate with the cylindrical convex portion of the upper housing to create a waterproof seal.

* * * * *